US006371022B1

(12) United States Patent
Crystal

(10) Patent No.: US 6,371,022 B1
(45) Date of Patent: Apr. 16, 2002

(54) DETACHABLE HANDLE FOR INKPADS

(76) Inventor: Enid R. Crystal, 8 Stratford Rd., Plainview, NY (US) 11803

( * ) Notice: Subject to any disclaimer, the term of this patent is extended or adjusted under 35 U.S.C. 154(b) by 0 days.

(21) Appl. No.: 09/620,542

(22) Filed: Jul. 22, 2000

Related U.S. Application Data

(60) Provisional application No. 60/146,766, filed on Jul. 31, 1999.

(51) Int. Cl.[7] ..... B41K 1/42

(52) U.S. Cl. ..... 101/333; 101/383; 101/405; 101/406

(58) Field of Search ..... 101/383, 333, 101/405, 406

(56) References Cited

U.S. PATENT DOCUMENTS 3,568,596 A * 3/1971 Mashburn ..... 101/405
3,973,495 A * 8/1976 Rowe ..... 101/405
4,202,139 A 5/1980 Hong
4,850,502 A 7/1989 Davis
5,191,837 A * 3/1993 Bolton ..... 101/333
5,870,953 A 2/1999 Winston
5,915,299 A * 6/1999 Kuriyama et al. ..... 101/128.1
6,067,905 A * 5/2000 Faber ..... 101/334
6,098,535 A * 9/2000 Lynn ..... 101/109

* cited by examiner

*Primary Examiner*—John S. Hilten
*Assistant Examiner*—Marvin P Crenshaw
(74) *Attorney, Agent, or Firm*—Bierman, Muserlian and Lucas

(57) ABSTRACT

A detachable handle for inkpads is described which is capable of temporarily placing a handle on an inkpad to aid the grasping and lifting of the inkpad for the purpose of applying ink to a surface without transferring ink to the fingers. The invention is comprised of a solid handle (1*a*) having a hook or loop fastener attached to one surface (1*b*), and a cooperating hook and loop fastener base (1*c*) which will be affixed by the user to the underside of an inkpad.

1 Claim, 1 Drawing Sheet

DETACHABLE HANDLE FOR INKPADS

CROSS REFERENCES

This application is entitled to the benefit of Provisional Patent Application Ser. No. 60/146,766 filed Jul. 31, 1999.

STATEMENT REGARDING FEDERALLY SPONSORED RESEARCH & DEVELOPMENT

Not applicable.

REFERENCE TO A MICROFICHE APPENDIX

Not applicable.

BACKGROUND OF THE INVENTION

The present invention relates to ink pads used with rubber stamps and, more particularly, to handles for ink pads used in artistic rubber stamping.

The stamping industry is divided into two distinct fields: the art stamping field and the industrial stamping field. In the industrial field, the impression to be formed usually comprises a single word or phrase formed in a single color. The rubber stamps used for this purpose are of limited size, normally fitting within the dimensions of a standard-sized inkpad.

In the art stamping field, on the other hand, the goal is to form an artistic image. There are wide variations in the size and design of rubber stamps used for this purpose. Many of these rubber stamps are quite large in size, extending beyond the dimensions of a standard sized inkpad. For these large rubber stamps, inkpads have been designed which have raised foam pads, which are impregnated with ink. The rubber stamp can be tamped onto the inkpad without being limited by the dimensions of the inkpad base. The limitation of this method is that the artist cannot see if the rubber stamp has been completely covered with ink in the desired way. Therefore, most rubber stamp artists prefer to place the rubber stamp face up on a table and turn the inkpad so that the ink side is facing down. They then grasp the inkpad by the sides of the case and tamp the inkpad onto the rubber stamp, thereby being able to see exactly where the ink is being applied. The disadvantage of this approach is that the fingers extend beyond the edges of the inkpad, invariably coming into contact with the inked surface of the rubber stamp. The ink from the fingers may inadvertently transfer to the artwork, ruining a work of art that might have been time-consuming to create.

Given the different goals underlying the use of rubber stamps in the art stamping field and in the industrial stamping field, most products designed for use in one field are not appropriate for use in the other field. This division between the two stamping fields is accentuated by the difference in the marketing and distribution channels for the two sets of products: art stamping supplies are usually sold through art, hobby supply, or gift stores, while industrial stamping supplies are usually available in office supply outlets.

The present invention is particularly effective when used in the field of art stamping. As briefly mentioned above, in the art-stamping field there are wide variations in the size and design of rubber stamps used. Specialized inkpads have been developed to accommodate them. The most commonly available specialized inkpads have a raised foam surface that is impregnated with ink.

An example of an inkpad designed to accommodate the problem of transferring ink to fingers, is described in U.S. Pat. No. 5,870,953 to Winston (1997) which is marketed under the name "Colorbox Options Plates". In this configuration, inkpads made of foam strips are arranged on a plastic base and can be impregnated with various ink colors. The small pads have a peg handle that protrudes from the bottom of the pad and serves to anchor it to the base, as well as being able to serve as a handle for a rubber stamp artist who wants to use it to tamp onto a rubber stamp. There are several disadvantages to this system, the primary one being that the inkpads must be manufactured specifically to this design. Another disadvantage of the aforementioned configuration is that the peg design of the handle is uncomfortable to hold after a short time. Additionally, in order for the user to release the "Options" plate, the plate needs to be reinserted into the base unit, a process that often results in transferring ink to the user's fingers.

Several devices exist in unrelated fields which use the hook and loop fasteners used in the present invention to attach handles to various objects. In U.S. Pat. No. 4,850,502 to Davis (1986), a detachable handle system for carrying containers is described which consists of two handles mounted to the sides of a container by hook and loop fasteners. U.S. Pat. No. 4,202,139 to Hong, et al. (1980) discloses a hand held sanding pad. Sand paper is adhered to one surface of the sanding pad and hook and loop fasteners are used to attach a soft, conformable handle to the opposite surface of the sanding pad.

BRIEF SUMMARY OF THE INVENTION

The object of the present invention is the provision of a novel and improved detachable handle for conveniently grasping and lifting an inkpad without getting ink on one's fingers.

OBJECTS AND ADVANTAGES

The objects and advantages of the present invention are:

(a) to provide a handle for conveniently grasping and lifting an inkpad to apply ink to a rubber stamp without getting ink on one's fingers (b) to provide a handle system that fits existing inkpads, thus providing an economical solution to the problem without the need to purchase a specially manufactured inkpad (c) to permit conventional (ink side up) use and storage of the inkpad when the handle is removed (d) to provide a handle that is ergonomic and comfortable to use (e) to provide a handle that may be removed with a minimum of effort My invention provides a detachable handle for any existing inkpad, thus providing the rubber stamp artist with the ability to use the handle with inkpads that they already own, making it economical. Further objects and advantages are: to provide a handle which is simple to use and inexpensive to manufacture, which can be packaged with multiple bases thus enabling one handle to be used with many inkpads, and is of such a size as to fit standard sized inkpads despite small variations in design of said inkpads.

BRIEF DESCRIPTION OF THE SEVERAL VIEWS OF THE DRAWING

DRAWING FIGURES

Figure 1:
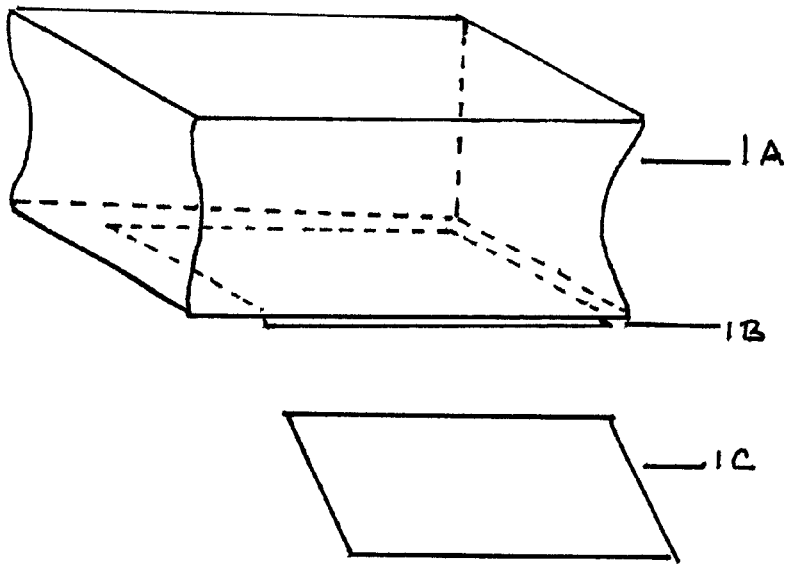

FIG. 1 shows an angled perspective of the handle; and

Figure 2:
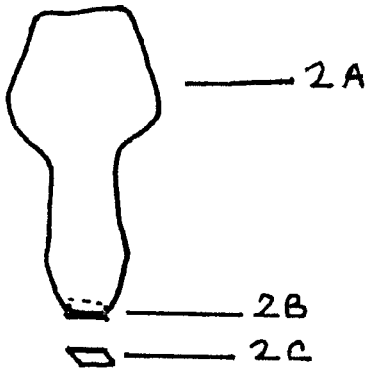

FIG. 2 shows an angled perspective of an additional embodiment handle.

DETAILED DESCRIPTION OF THE INVENTION

A preferred embodiment of the handle system is illustrated in FIG. 1. in the preferred embodiment, the handle 1A is constructed of acrylic, but it may also be constructed of other solid dense material, such as wood, heavy rubber, or plastic. The underside of the handle is of such a size and shape as to fit within the dimensions of an existing inkpad. The handle is contoured to comfortably fit the hand. One plane of the handle has permanently affixed upon it a mounting means of either member of the hook and loop fastener 1B. Said mounting means is adhered to the handle by means of an adhesive backing on the hook and loop material. The opposing hook and loop fastener 1C is permanently affixed by the user to the bottom of an existing inkpad prior to attaching the handle. This matching member of hook and loop will be of the self-stick variety, and easy for the user to apply. When desired by the user, the mounting means on the handle is pressed onto its matching hook and loop member on the inkpad such that the hook and loop elements interlock creating a secure but temporary bond.

The detachable handle system is manufactured to accommodate inkpads of different shapes, as there exist on the market inkpads with oval, wavy, and rectangular outlines, but will be designed in such a way as to be used interchangeably on inkpads of approximately the same size regardless of the shape of the inkpad.

When desired by the user, the handle is easily removed by pulling it away from the base member. The inkpad can then be used in the conventional "ink side up" manner, as the hook tape applied to the bottom of the inkpad is of such a dimension as to fit within the confines of the recessed bottom of most inkpads. Additionally, the hook and loop tape member affixed to the underside of the inkpad is flat enough to permit stacking and storage of the inkpad, as the inkpad designers intended.

The preferred embodiment of the current invention is illustrated in FIG. 1 and shows a roughly rectangular contoured handle 1A with loop fastener 1B affixed to it. The base member 1C is also shown, which would be composed of matching hook fastener.

Additional Embodiments

An additional embodiment of the present invention is illustrated in FIG. 2. To accommodate inkpads of much smaller dimension, a different configuration of the handle that will allow it to fit within the confines of a smaller inkpad, is required. In this embodiment, the handle is more of an upright knob shape. The function and method of operation are identical to that of the preferred embodiment. There is a handle 2A with a loop fastener 2B affixed to it and a separate matching base member 2C.

Alternative Embodiments

An alternative embodiment of the present invention could substitute adhesive backed magnetic strips for hook and loop fastener to secure the handle to the inkpad.

ADVANTAGES

From the description above, a number of advantages of my detachable handle for inkpads become evident:

(a) The handle will work with existing inkpads, thus being economical for user as it does not require the user to buy specialized inkpads (b) The handle will be designed to be in an ergonomic shape, thus being comfortable to use for long period of time (c) When the handle is detached, it will permit the inkpad to be used in a conventional "ink side up" manner, thus giving the user the choice of how to use the inkpad.

OPERATION

The manner of using the detachable handle for inkpads is quite simple. The user will affix the base member "hook" fastener 1C to the underside of the existing inkpad by removing the hook tape from the backing to expose the adhesive. The user then presses the adhesive onto the inkpad, which will affix the hook tape to it. The user then grasps the handle 1A and presses it so the "loop" fastener 1B on the handle meshes with the "hook" fastener on the inkpad. The user then lifts the handle with the inkpad now attached to it and brings the inkpad to the surface to which they desire to transfer ink.

To remove the handle from the inkpad, the user simply pulls the handle away from the "hook" fastener on the inkpad.

CONCLUSION, RAMIFICATIONS AND SCOPE

Accordingly, the reader will see that the detachable handle for inkpads man be produced economically. It can be used easily and conveniently by the rubber stamp artist. Further, the detachable handle for inkpads can be removed easily from the inkpad and permit the inkpad to be used and stored in the conventional "ink side up" manner.

A novel detachable handle system for inkpads, which is efficient and effective to use, has thus be shown and described. As numerous modifications and alternate embodiments will occur to those skilled in the arts, it is intended that the invention be limited only in terms of the appended claims.

I claim:

1. A detachable handle system for artist inkpads comprising:

a handle having at least one flat surface;

one member of a hook and loop fastener affixed to said one flat surface of said handle; and at least one other member of a hook and loop fastener, said other member having an adhesive backing for adhering to a back of an artist inkpad, thereby allowing said handle to be affixed to at least one artist inkpad by means of said hook and loop fastener so that ink from said inkpad can be applied to a rubber stamp.

* * * * *